US010738569B2

(12) United States Patent
Tran

(10) Patent No.: US 10,738,569 B2
(45) Date of Patent: Aug. 11, 2020

(54) CONNECTION BETWEEN AN OIL AND GAS FRACTURING TREE AND A ZIPPER MODULE

(71) Applicant: Seaboard International, Inc., Houston, TX (US)

(72) Inventor: Duc Thanh Tran, Spring, TX (US)

(73) Assignee: Seaboard International Inc., Houston, TX (US)

( * ) Notice: Subject to any disclaimer, the term of this patent is extended or adjusted under 35 U.S.C. 154(b) by 111 days.

(21) Appl. No.: 16/029,560

(22) Filed: Jul. 7, 2018

(65) Prior Publication Data

US 2019/0010781 A1 Jan. 10, 2019

Related U.S. Application Data

(60) Provisional application No. 62/530,088, filed on Jul. 7, 2017.

(51) Int. Cl.

| | |
|---|---|
| ***E21B 34/02*** | (2006.01) |
| ***E21B 43/26*** | (2006.01) |
| ***E21B 33/068*** | (2006.01) |
| ***E21B 33/02*** | (2006.01) |

(52) U.S. Cl.

CPC ..... *E21B 34/02* (2013.01); *E21B 33/02* (2013.01); *E21B 33/068* (2013.01); *E21B 43/26* (2013.01)

(58) Field of Classification Search

CPC ..... E21B 43/26; E21B 33/02; E21B 33/068; E21B 34/02

See application file for complete search history.

(56) References Cited

U.S. PATENT DOCUMENTS

| | | | |
|---|---|---|---|
| 2007/0125543 | A1 | 6/2007 | McNeel et al. |
| 2010/0066074 | A1 | 3/2010 | Crompton |
| 2012/0181030 | A1* | 7/2012 | Kajaria ..... E21B 43/26 166/308.1 |
| 2013/0175039 | A1 | 7/2013 | Guidry |
| 2013/0233560 | A1 | 9/2013 | Davidson |
| 2014/0048158 | A1 | 2/2014 | Baca et al. |
| 2017/0138144 | A1 | 5/2017 | Christopherson et al. |

OTHER PUBLICATIONS

PCT Written Opinion, dated Oct. 1, 2018, regarding Application No. PCT/US2018/041160, 10 pages.

* cited by examiner

*Primary Examiner* — Kristyn A Hall
(74) *Attorney, Agent, or Firm* — Foley & Lardner LLP

(57) ABSTRACT

An oil and gas configuration is disclosed that creates and uses a single straight-line fluid path between a zipper module and a fracturing (or Christmas) tree. The single straight-line fluid path is created through connecting a series of valves (e.g., manual or automatic gate or plug valves) that coaxially share inner fluid passageways for transporting hydraulic fracturing fluid between the zipper module and the fracturing tree. The hydraulic fracturing fluid flows along the single straight-line fluid path upon from the zipper module to the fracturing tree. The fracturing tree is equipped with a multi-way block that directs—through one or more internal angled walls—the hydraulic fracturing fluid downward and toward a wellhead.

20 Claims, 11 Drawing Sheets

CONNECTION BETWEEN AN OIL AND GAS FRACTURING TREE AND A ZIPPER MODULE

CROSS-REFERENCE TO RELATED APPLICATIONS

This application claims priority to U.S. Provisional Application No. 62/530,088, filed Jul. 7, 2017 and entitled CONNECTION BETWEEN AN OIL AND GAS CRATURING TREE AND A MANIFOLD MODULE, the entire disclosure of which is hereby incorporated herein by reference for all intents and purposes.

BACKGROUND

In oil and gas operations, hydraulic fracturing systems may be used to fracture one or more subterranean formations by conveying pressurized hydraulic fracturing fluid to one or more wellbores traversing the subterranean formation(s), the wellbore(s) each having a wellhead located at the surface termination thereof. These hydraulic fracturing systems require temporary surface lines, valves, and manifolds (collectively referred to as "frac iron") to deliver the hydraulic fracturing fluid from mixing and pumping equipment to one or more fracturing trees connected to the respective wellhead(s). A fracturing manifold consists of one or more "zipper modules," which are a collection of flow iron valves, pipes, and components, used to deliver hydraulic fracturing fluid or treatment fluid to multiple fracturing trees. The zipper modules facilitate quick redirection of fracturing fluid and pressure from one well to another, enabling pumping trucks or machinery to run nearly continuously and thereby minimize downtime.

Many hydraulic fracturing systems use conventional frac iron connected to, from, or between: each of the various components of the fracturing manifold, the pressurization manifold and the fracturing manifold, each of the various components of the pressurization manifold, and/or each of the fracturing trees and the fracturing manifold. In particular, zipper modules typically comprise a series of gates, valves, and piping set up to deliver fracturing fluid to the wellhead. Wellheads are situated at different elevations in the field, making it essential for zipper modules to deliver fluids at varying inclinations and declinations and at different angles. For example, one wellhead may be situated at point A, another wellhead may be situated at point B that is X meters east and Y meters above point A, and still another wellhead may be situated at point C that is X' west and Y' below point A. To effectively traverse this terrain, conventional setups connect each zipper modules to the wellheads using a complex network of piping and frac iron form the zipper modules to the wellheads. Running multiple pipes from each zipper module to each wellhead creates a multitude of issues at the work site including, but not limited to, excessive setup time and labor costs, limited adjustability, safety risks associated with potential leak points, and decreased pumping efficiency.

SUMMARY

The disclosed examples are described in detail below with reference to the accompanying drawing figures listed below. This Summary is provided to illustrate some examples disclosed herein and is not meant to necessarily limit all examples to any configuration or sequence of operations.

One embodiments are directed to a system for establishing a single straight-line fluid path between a fracturing (frac) tree stack and a zipper tree. The system includes: a fluid conduit, a first valve, and a second valve. The fluid conduit, the first valve, and the second valve are coaxially connected to create the single straight-line fluid path along a shared axis between the frac tree and the zipper tree for delivering fluid therebetween.

In some embodiments, the first valve and the second valve each comprise a gate valve.

In some embodiments, the first valve and the second valve each comprise a plug valve.

In some embodiments, the first valve comprises a gate valve and the second valve comprise a plug valve.

In some embodiments, the first valve is manually actuated and the second valve is automatically actuatable.

In some embodiments, the first valve and the second valve are each manually actuatable.

In some embodiments, the first valve and the second valve are each automatically actuatable.

In some embodiments, the first valve or the second valve comprise at least one automatically actuatable valve that may be opened and closed either electrically, electromagnetically, pneumatically, or hydraulically.

In some embodiments, the fluid conduit is connected to an end of the zipper tree, and the first valve is connected to an end of the fluid conduit.

In some embodiments, the fluid conduit is connected between the first valve and the second valve.

In some embodiments, the fluid conduit is connected to a multi-way block that is part of the frac tree.

In some embodiments, the frac tree comprises a multi-way block.

In some embodiments, the multi-way block comprises an internal angled passage that directs fluid received from the single straight-line fluid path to an internal passage of the frac tree directed toward a wellhead.

In some embodiments, the multi-way block comprises at least one member of a group comprising a 3-way, 4-way, or 5-way block with at least one discharge directed to the wellhead.

Other embodiments are directed to a system comprising a fracturing (frac) tree and a zipper module. The system includes two or more valves that are coaxially connected in series between the frac tree and the zipper module. The two or more valves define a single straight fluid path between the zipper module and the frac tree for frac fluid to flow.

In some embodiments, the zipper module defines a first internal fluid passage within the single straight fluid path between the zipper module and the frac tree, the first internal fluid passage being perpendicular to a second internal fluid passage within a second fluid passage within interconnected flow iron of the zipper module.

In some embodiments, the zipper module comprises a zipper tree situated on a base that is adjustable in elevation.

In some embodiments, the zipper module comprises at least rotatable block for receiving the frac fluid.

In some embodiments, the frac fluid is supplied to the at least one rotatable block of the zipper module through a conduit having an internal diameter within a range of 3-7 inches.

Still other embodiments are directed to a system for performing hydraulic fracturing of a plurality of wellheads on a frac site. The system includes at least one zipper tree comprising at least one rotatable block for receiving frac fluid for use in performing they hydraulic fracturing; and an OSL connection comprising at least one gate valve and at least one OSL fluid conduit connected in series and defining a single straight fluid path from the at least one zipper tree to a frac tree.

BRIEF DESCRIPTION OF THE DRAWINGS

Notwithstanding any other forms that may fall within the disclosure set forth above in the Summary, embodiments are described below by way of example and with reference to the accompanying drawings that include the following.

DETAILED DESCRIPTION

Figure 1:
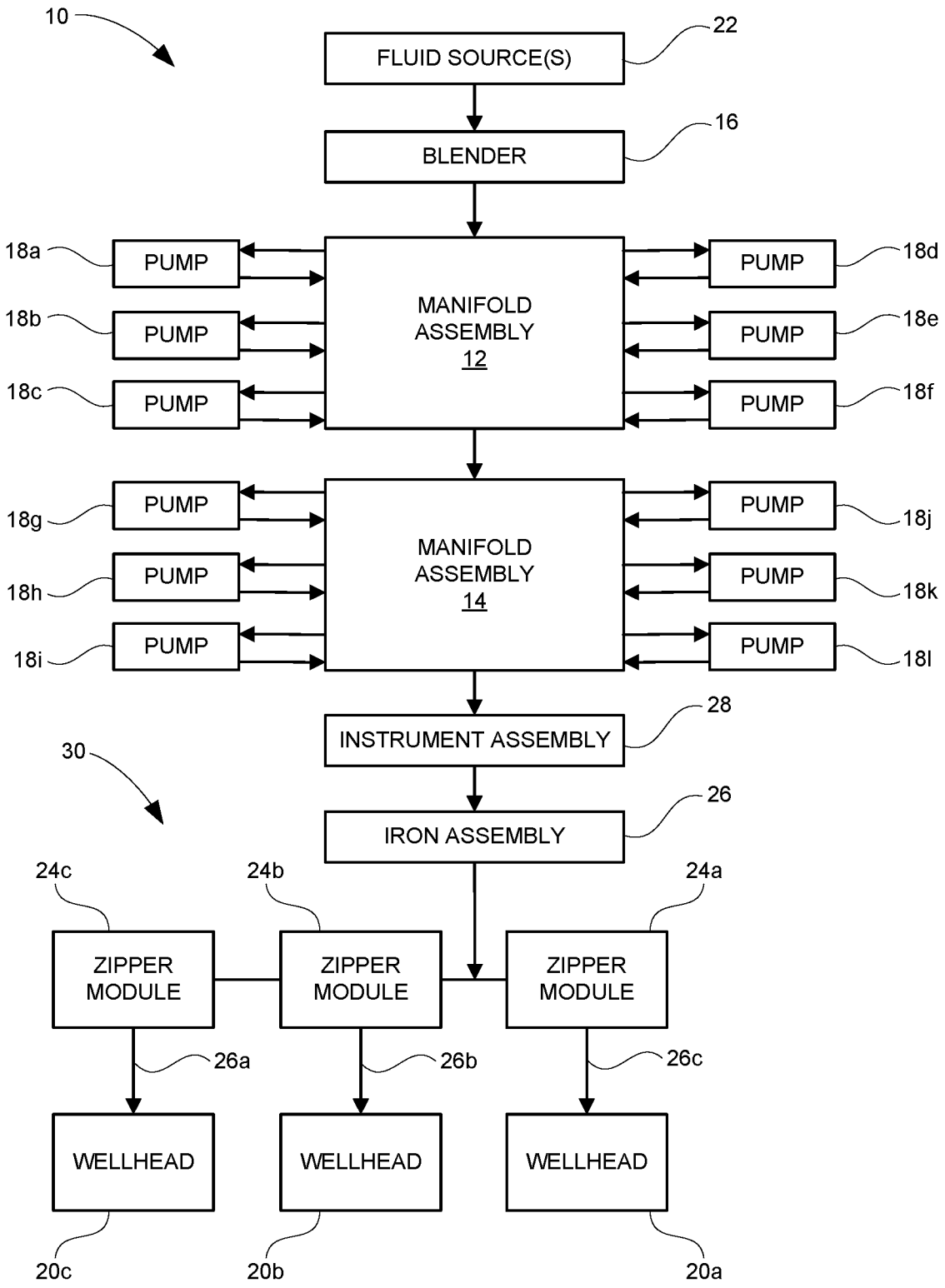
FIG. 1 is a block diagram of a hydraulic fracturing network that includes multiple zipper modules that are both interconnected and connected to multiple wellheads, according to some embodiments.

Some of the embodiments disclosed herein provide various configurations to deliver a connection between zipper modules receiving hydraulic fracturing fluid ("frac fluid") to a hydraulic fracturing tree ("frac tree") for hydraulically fracturing an oil and gas well. The frac trees and zipper modules may be situated out in an oil and gas field across uneven terrain and with differing heights, making the connection of the two conventionally difficult. Examples of frac fluid include, without limitation, water, slickwater, sand, bauxite, or any other fracturing fluid. The connections disclosed herein are created using one or more valves and pipes that form a single straight-line fluid conduit that are coaxially connected along a shared axis to create what is referred to below as a "one straight line" (referred to simply as "OSL") connection between the frac tree and the manifold module for transporting frac fluid therebetween. As referenced herein, an "OSL connection" refers to a single straight-line fluid path defined within interconnected flow iron connecting a zipper tree and a frac tree.

The OSL connections disclosed herein provide a much more efficient way to connect zipper modules to frac trees. Single connection points are used between zipper modules and frac trees as well (in some embodiments) as between multiple zipper modules to allow flow of frac fluid between the zipper modules themselves. Instead of needing multiple connections between a zipper module and a frac tree, only a single connection is needed. This substantially reduces the complexity of the network of frac iron needed to communicate frac fluid to different frac trees and across varying elevations or directions.

The disclosed OSL connections may be used in fracturing operations or in flowback operations. In flowback operations, the disclosed OSL connections may be connected between the wellhead and a completion or storage tank, using any of the disclosed OSL connections described herein to carry flowback fluid or slurry (e.g., water, sand, frac load recover, proppant, slurry, or the like) away from the wellhead. For the sake of clarify, embodiments disclosed herein refer to OSL connections in fracking operations, i.e., providing frac fluid to the frac tree or wellhead.

The flow iron used to create the OSL connections described herein may include various interconnected flow iron components to create an internal conduit for fracturing fluid to pass form the zipper module to the frac tree. Examples of such flow iron components include pipes, hoses, safety restraints, and any of a number of flow iron valves. Examples of flow iron valves that may be used in the OSL connections mentioned herein include, without limitation, acid valves, API valves, ball valves, butterfly valves, check valves, choke valves, diaphragm valves, gate valves, glove valves, isolation valves, knife gate valves, (pilot-operated or non-pilot operated) pressure relief valves, pinch valves, plug valves, (mechanical and non-pressurized) filing valves, safety relief valves, or the like. Such valves may be manually, electrically, electromagnetically, pneumatically, hydraulically, or otherwise actuated. The above valves and actuation mechanisms, as well equivalents thereof, may be considered "valve means" and "actuation means," respectively.

While embodiments disclosed herein create OSL connections with specific configurations of gate or plug valves connected to piping, any of the aforementioned valves—and actuation mechanisms—may alternatively be used to create the disclosed OSL connections. Unless otherwise stated herein, the illustrated and depicted embodiments are meant to be non-limiting and non-exhaustive of all embodiments for creating OSL connections. Different valves, piping, and other flow iron may be used to create OSL connections, and such alternative configurations are fully contemplated herein.

Turning to FIG. 1, a hydraulic fracturing ("fracking" or "frac") site 10 is equipped with manifold assemblies 12 and 14 in fluid communication with a blender 16, hydraulic fracturing pumps 18*a*-1, and wellheads 20*a-c*. The frac site 10 includes one or more fluid sources 22 that are in fluid communication with the blender 16. The wellheads 20*a-c* are in fluid communication with the manifold assemblies 12 and 14 via, for example, zipper modules 24*a-c*, an iron assembly 26, and an instrument assembly 28. The zipper modules 24*a-c* are connected to the wellheads 20*a-c*, respectively, and are interconnected with each other to form a "zipper manifold" 30 to which the iron assembly 26 is connected. The instrument assembly 28 is connected to both the iron assembly 26 and the manifold assembly 14. Operationally, the frac site 10 is used to facilitate oil and gas exploration and production operations. The embodiments provided herein are not, however, limited to a hydraulic frac system, as the embodiments may be used with, or adapted to, a mud pump system, a well treatment system, flowback system, other pumping systems, one or more systems at the wellheads 20*a-c*, one or more systems upstream of the wellheads 20*a-c*, one or more systems downstream of the wellheads 20*a-c*, or one or more other systems associated with the wellheads 20*a-c*.

In operation, hydraulic fracturing fluid ("frac fluid") contained in the fluid sources 22 is pumped by the various pumps 18*a*-1 through the manifold assemblies 12-14, which may or more may not pressurize the pumped fluid, to the zipper modules 24*a-c*. The so-provided frac fluid is, in some embodiments, passed through the iron assembly 26, monitored by the instrument assembly 28, and to the zipper modules 24*a-c*, where the frac fluid is distributed therebetween. For example, as depicted in FIG. 1, the frac fluid may be pumped to a connection between zipper modules 24*a* and 24*b*, dispersed to those two zipper modules 24*a* and 24*b*, and then communicated through zipper module 24*b* to zipper module 24*c*. In this configuration, a network is formed to distribute the frac fluid between the zipper modules 24*a-c*.

The zipper modules 24*a-c* represent a vertical structure of flow iron used to elevate frac fluid from the iron assembly 26 to an OSL connection 26*a-c*. The wellheads 20*a-c* represent frac trees (or Christmas trees) for receiving the frac fluid from the zipper modules 24*a-c*, via the OSL connections 26*a-c*, and supplying the frac fluid to various oil and gas wells.

In some embodiments, OSL connections 26*a-c* discussed in more detail below are used to provide straight-line fluid pathways between the zipper modules 24*c-a* and the wellheads 20*c-a*, respectively. For example, OSL connection 26*a* provides fluid communication of frac fluid between zipper module 24*c* and wellhead 20*c*; OSL connection 26*b* provides fluid communication of frac fluid between zipper module 24*b* and wellhead 20*b*; and OSL connection 26*c* provides fluid communication of frac fluid between zipper modules 24*a* and 20*a*. This depicted setup may be extended to provide any number of interconnected zipper modules 24 to each other and also to wellheads 20 via OSL connections 26.

Figure 2:
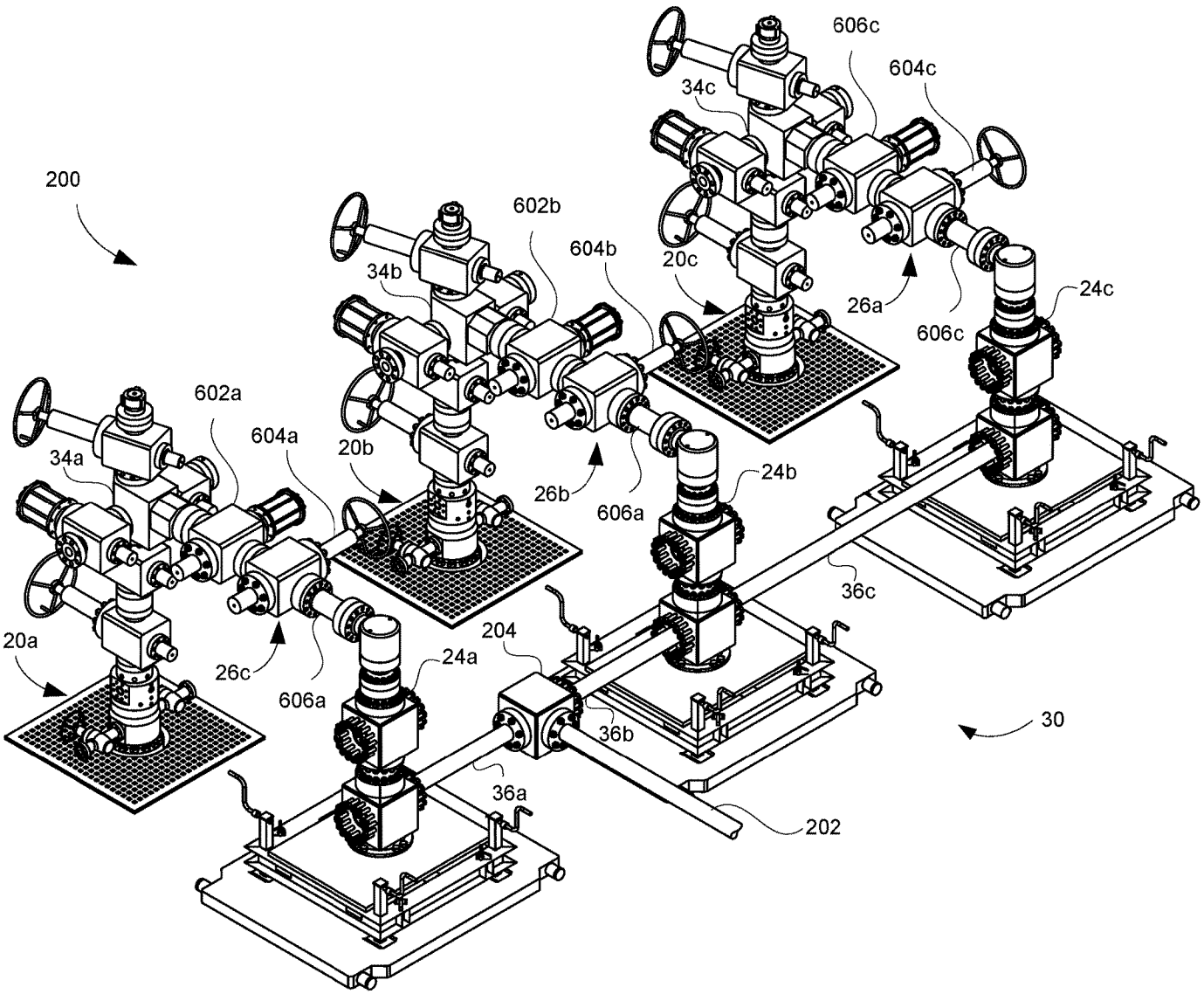
FIG. 2 is a perspective view of the one or more zipper modules being connected to, and in fluid communication with, one or more wellheads via one or more fluid conduits and one or more frac trees, according to some embodiments.

FIG. 2 illustrates an interconnected fracking setup 200 of multiple frac trees 34*a-c* being connected to multiple zipper modules 24*a-c* via separate OSL connections 26*c-a*. In the depicted embodiment, the OSL connections 26*c-a* provide fluid conduits for frac fluid delivered to the zipper modules 24*a-c* via inlet pipe 202 to be delivered from the respective zipper modules 24*a-c* to their respectively coupled frac trees 34*a-c*. The wellheads 20*a-c* are connected to the frac trees 34*a-c*, respectively, and the fluid conduits 32*a-c* are connected to the frac trees 34*a-c*, respectively. The respective zipper modules 24*a-c* are connected to, and in fluid communication with, the wellheads 20*a-c* via respective pairs of the fluid conduits 32*a-c*, frac trees 34*a-c*, and OSL connections 26*c-a*.

The wellheads 20*a-c* are each located at the top or head of an oil and gas wellbore (not shown) that penetrates one or more subterranean formations (not shown) and are used in oil and gas exploration and production operations. To form the zipper manifold 30, the zipper modules 24*a* and 24*b* are interconnected with each other via fluid conduits 36*a,b* and block 204, and the zipper modules 24*b* and 24*c* are interconnected with each other via a fluid conduit 36*c*. Block 204 connects the zipper manifold 30 to the iron assembly 26 shown in FIG. 1. As such, only a single inlet point is needed to supply frac fluid (even at different pressures) to the zipper modules 24*a-c* via the fluid conduits 36*a,b,c*. In an alternative embodiment, rather than the fluid conduits 36*a,b* including the block 204, the fluid conduit 36*c* includes the block 204 to thereby connect the zipper manifold 30 to the iron assembly 26 at a different access point. In another alternative embodiment, the block 204 or the pipe 202 is instead connected directly to one of the zipper modules 24*a-c*.

The wellheads 20*a-c* may be substantially identical to each other. Likewise, the frac trees 34*a-c* may be substantially identical to each other, and, therefore, in connection with FIGS. 3-6, only a general frac tree 34, wellhead 20, zipper module 24, and OSL connection 26 are described in detail below. Yet, such disclosures of these components below encompass any of the frac trees 34*a-c*, wellheads 20*a-c*, and OSL connections 26*a-c*.

The illustrated embodiment is scalable to provide any number of interconnected zipper modules 24, OSL connections 26, and frac trees 34. To accommodate larger setups, the diameter of the intake pipe 202 delivering the frac fluid may be increased. For example, the pipe 202 may have an inner diameter ranging between 3-7 inches. In particular examples, the pipe 202 has an inner diameter of 3, 3.25, 3.5, 3.75, 4, 4.25, 4.5, 4.75, 5, 5.25, 5.5, 5.75, 6, 6.25, 6.5, 6.75, or 7 inches.

OSL connection 26*a* includes a straight-line connection of an OSL conduit 606*a* (which may be pipe or hose), a manually actuated gate valve 604*a*, and an automatically actuated gate valve 602*a*. Similar OSL connections are shown for OSL connections 26*b* and 26, having respective conduits 606*b,c*; manual gate vales 606*b,c*; and automatic gate valves 606*b,c*. As discussed in more detail below, these OSL connections 26*a-c* are merely examples. Other OSL connections 26 may use different combinations of gate, plug, or other types of valves as well as other lengths of conduits, or no conduits at all (e.g., just connect valves together.

Figure 3:
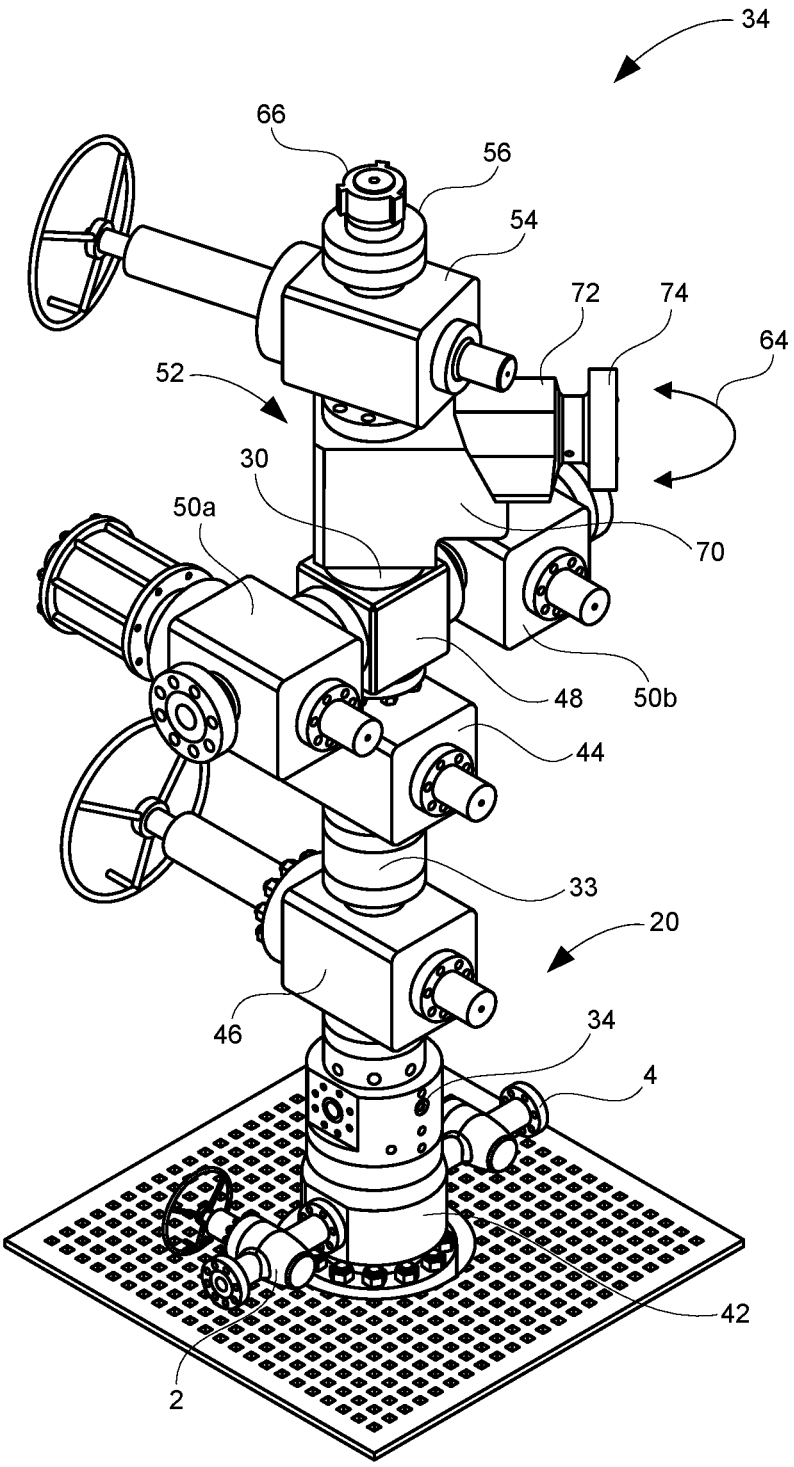
FIG. 3 is a perspective view of a fracturing tree, according to some embodiments.

FIG. 3 illustrates a perspective view of a frac tree 34 that is connected to a wellhead 20, according to some embodiments. The frac tree 34 operationally directs frac fluid, through a sequence of flow iron from an OSL connection 26 connected to a zipper module 24 to a wellhead 20. Specifically, in one embodiment, the frac tree 34 includes an adapter 42 mounted with opposing side valves, such as, for example wing gate valves 2 and 4; a pair of master valves, such as, for example, upper and lower gate valves 44 and 46; a production tee 48; a multi-way block 52; a swab valve 54 (e.g., a gate valve), and a tree adapter 56. In some embodiments, the upper and lower gate valves 44 and 46 are connected to each other in series above the adapter 42. In some embodiments, the upper gate valve 44 is an automatic gate valve, and the lower gate valve 46 is a manual gate valve. Other valves besides gate valves may be used. For example, plug valves replace the shown upper and lower gate valves 44 and 46 in some embodiments.

The adapter 42 is connected to the lower gate valve 46 and facilitates connection of the wellhead 20*a* to a casing string (not shown) and/or a tubing string (not shown) extending within the associated wellbore. The production tee 48 is connected to the upper gate valve 44 and has a production wing valve 50*a* and a kill wing valve 50*b* connected thereto.

The multi-way block 52 is connected to the production tee 48, opposite the upper gate valve 44, and includes a block 58 that with a fluid conduit for receiving frac fluid from a zipper module 24 via an OSL connection 26 and directing the receive frac fluid downward through a fluid channel defined by the production tee 48, gate valves 44 and 46, and a production spool 34. Put another way, frac fluid enters the frac tree through the multi-way block 52 and passes down through an internal fluid channel in the wellhead 20. The multi-way block 52 may take the form of a three-way valve (as depicted in FIG. 3), as a five-way valve (as depicted in FIGS. 6-10), or a as a two-way valve (without the upper swab valve 54). As depicted by arrow 64, the multi-way block 52 is rotatable around an axis defined by the fluid channel in the frac tree (e.g., a vertical axis). For example, the multi-way block 52 may be rotated 360 degrees or less to properly align with an OSL connection 26 from a zipper module 24. This provides at least one rotational degree of flexibility for connecting zipper modules 24 to the frac tree 34.

In some embodiments, the multi-way block 52 is reinforced or includes a durable insert or layer of material (e.g., zirconia, partially stabilized zirconia, tungsten carbide, tungsten carbide nickel, tungsten carbide cobalt, titanium carbide, silicon nitride, sialon, silicon, silicon nitride, ceramic, or other hardened material) along the angled wall 98 and/or the back wall 99 of the shown internal passages. Such reinforcement dramatically reduces wear at the most impacted points of the multi-way block 52. Aside from a hardened material, these walls 98, 99 may be reinforced with steel, iron, or other metal; a dampening material (e.g., polyurethane); or a combination thereof.

Figure 4:
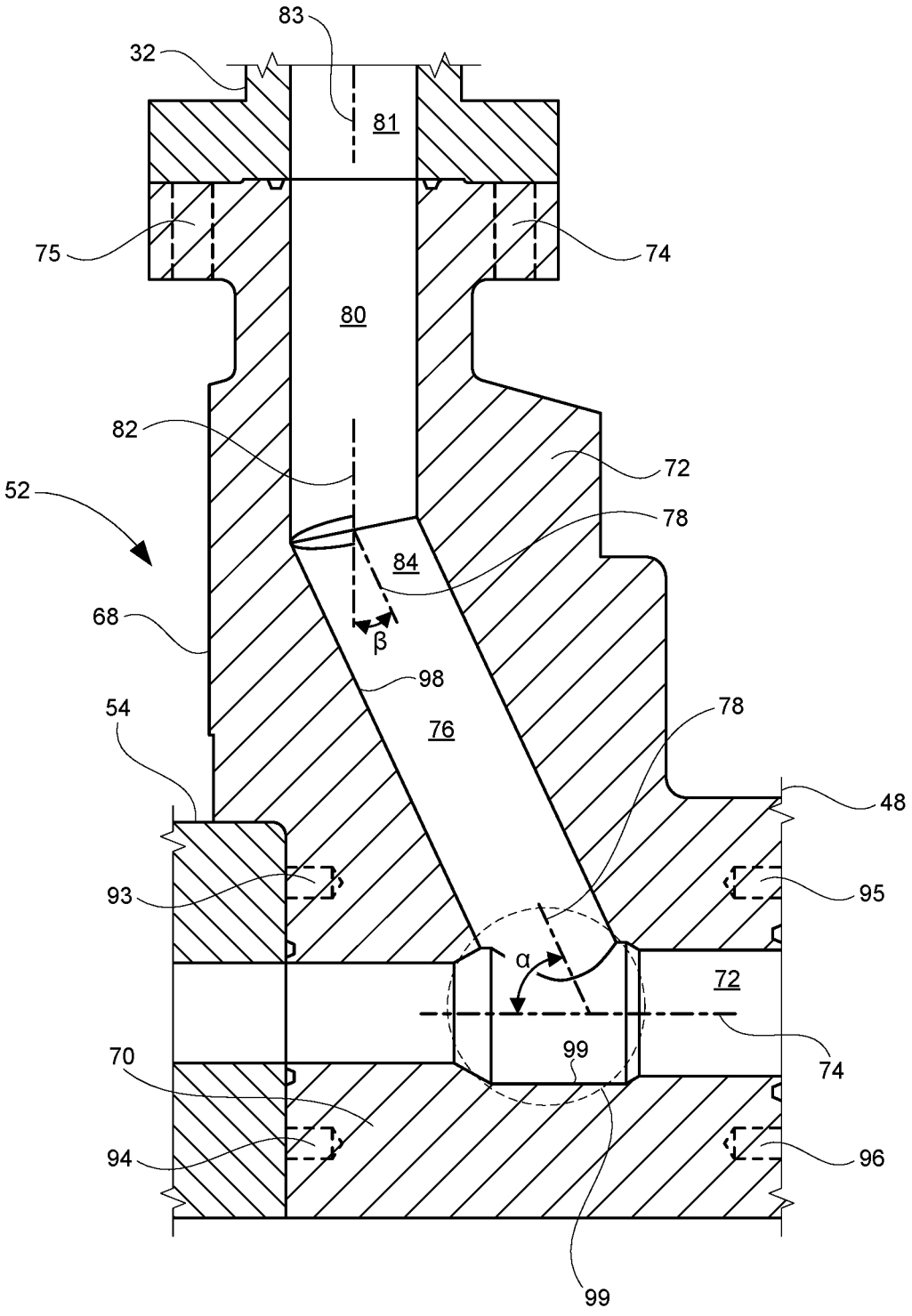
FIG. 4 is a cross-section view of a multi-way block used in a fracturing tree, according to some embodiments.

FIG. 4 illustrates a cross-section view of one embodiment of the multi-way block 52 on the frac tree 34. In one embodiment, the multi-way block 52 is an integral block comprising a horizontal inlet segment 68 that is integrally connected to a vertical outlet segment 70. The multi-way block 52 may be fashioned out of steel or other metal and defines various passageways 80, 86, and 72 for directing frac fluid from an OSL connection toward a wellhead 20.

The outlet segment 70 is connected between, and in fluid communication with, the production tee 48 and the swab valve 54 (shown, e.g., in FIG. 3), using bolts or fasteners 93-96 as shown. In an embodiment, the inlet segment 68 and the outlet segment 70 are integrally formed. Alternatively, the inlet segment 68 and the outlet segment 70 are separate pieces that are fastened, bolted, screwed, pinned, welded, or otherwise connected. The inlet segment 68 is connected between, and in fluid communication with, the outlet segment 70 and the fluid conduit 32 (shown, e.g., in FIG. 2).

The outlet segment 70 defines an outlet passage 72 through which the outlet segment 70 is in fluid communication with the production tee 48 and the swab valve 54—along opposite sides. The outlet passage 72 extends through the outlet segment 70 along an axis 74. The outlet segment 70 also defines an angled inlet passage 76 via which the outlet segment 70 is in fluid communication with the inlet segment 68. The inlet passage 76 declines from horizontal axis 82 of inlet passage 80 in the inlet segment 68 toward upward and toward from the outlet passage 72 along an angled axis 78 that is oriented at angle α and β relative to the horizontal axis 82 of the inlet passage 80 and the vertical axis 74 of the outlet of the outlet passage. In operation, frac fluid enters the multi-way block 52 along passage 81 of the OSL connection 26, travels horizontally along passage 80, downward along passage 76, and either up toward the swab valve 54 or down toward the wellhead 20 via passage 72.

The inlet segment 68 defines an inlet passage 80 via which the inlet segment 68 is in fluid communication with a single straight-line fluid path 81 of the fluid conduit 32*a* (shown, e.g., in FIG. 2). The inlet passage 80 of the inlet segment 68 is aligned with the single straight-line fluid path 81 of the fluid conduit 32. The inlet passage 80 extends along an axis 82. The single straight-line fluid path 81 extends along an axis 83. In an embodiment, the inlet passage 80 of the inlet segment 68 is substantially coaxial with the single straight-line fluid 81 of the fluid conduit 32 (i.e., the axes 82 and 83 are substantially coaxial). But the inlet passage 80 of the inlet segment 68 need not be substantially coaxial with the single straight-line fluid 81 of the fluid conduit 32 to be otherwise aligned therewith.

The inlet segment 68 also defines an outlet passage 84 via which the inlet segment 68 is in fluid communication with the outlet segment 70. The outlet passage 84 extends downward toward the production spool 48 from the inlet passage 80 along an axis 86 oriented at an angle β with respect to the axis 82 of the inlet passage 80. In an embodiment, the outlet passage 84 of the inlet segment 68 is substantially coaxial with the inlet passage 76 of the outlet segment 70 (i.e., the axes 78 and 86 are substantially coaxial). In some embodiments, the sum of the angles α and β is about 90 degrees. The coaxial extension of the inlet and outlet passages 76 and 84 at the angles α and β, respectively, reduces wear and excessive turbulence in the block 58 by, for example, easing the change in the direction of fluid flow and eliminating blinded-off connections.

Additionally, in some embodiments, the multi-way block 52 is a 4- or 5-way block with valves (e.g., gate or plug) connected on each side, as shown in more detail in FIGS. 6-10. As such, additional fluid passages may be positioned into and out of the multi-way block 52, as shown by the dotted circle 78. In this embodiment, valves are connected to the multi-way block 52 at location 78 on opposite sides. In such embodiments, fluid may pass into the multi-way block 52 at passage 80 and out the block in four other discharge areas: toward the wellhead 20, toward the swab valve 54, and two each of the side valves at opposite locations of 78. This provides a five-way multi-way block 52 that may be used to direct frac fluid into and out of the connected wellheads 20 and the zipper modules 24 disclosed herein.

Turning back to FIG. 2, with continuing reference to FIG. 4, the fluid conduits 32*a-c* include OSL conduits (e.g., pipes) 606*a-c* and gate valves 604*a-c* and 602*a-c*. In some embodiments, the gate valves 604*a-c* and 602*a-c* are manual or automatic gate valves. In other embodiments, the gate valves 604*a-c* and 602*a-c* are manual or automatic plug valves (not shown).

Figure 5:
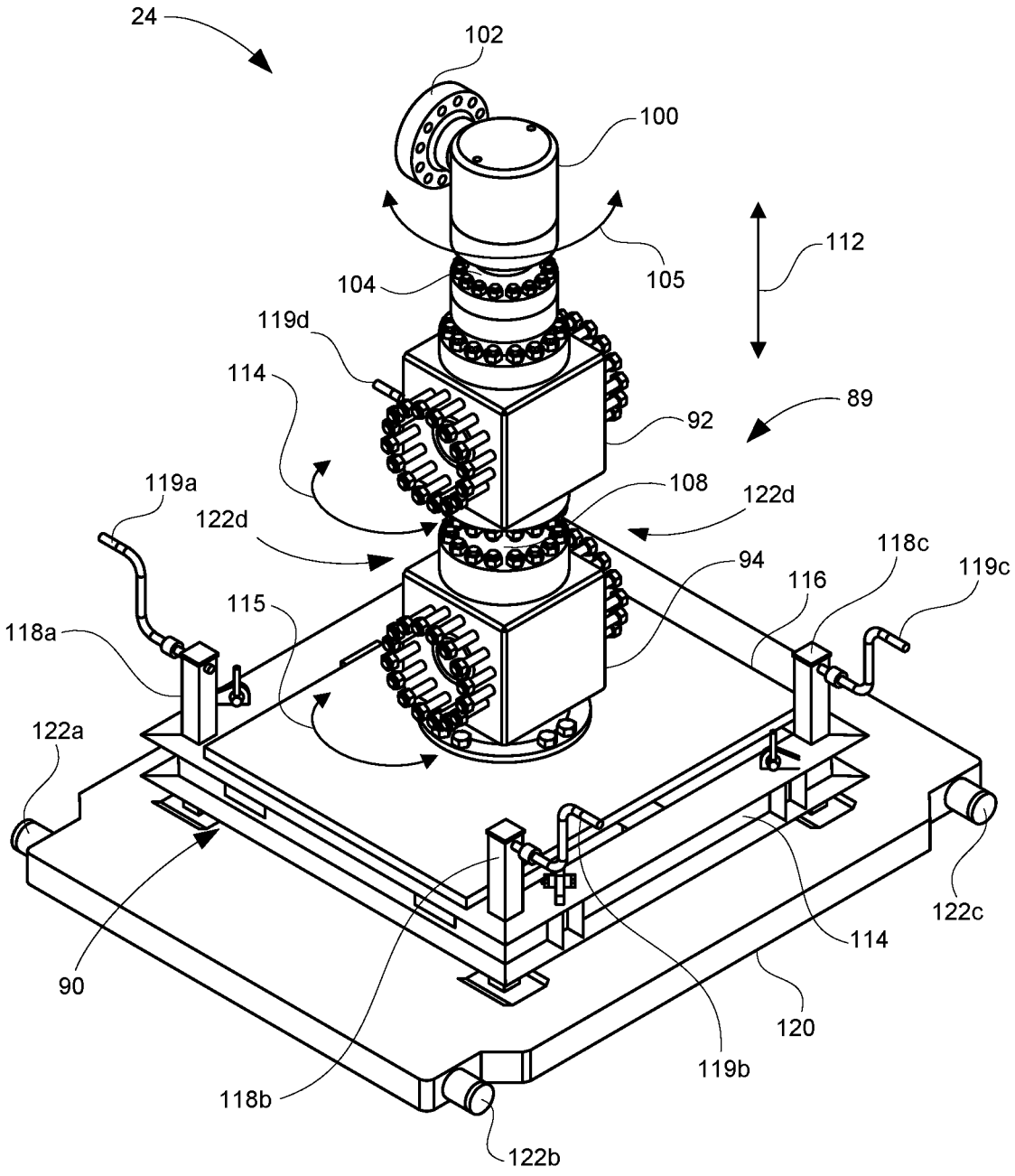
FIG. 5 is a perspective view of a zipper module, according to one or more embodiments.

FIG. 5 illustrates a perspective view of the zipper module 24, according to some embodiments. The adjustable skid 90 is configured to displace the zipper tree 89 to align upper and lower blocks 92 and 94 of the zipper module 24 with corresponding upper and lower blocks 92 and 94 of another zipper module 24. More specifically, the adjustable skid 90 is configured to displace the zipper tree 89 up and down in the vertical direction as indicated by linear arrow 112. In some embodiments, the adjustable skid 90 includes a generally rectangular base 114, a carriage plate 116 supported on the base 114, and jacks 118*a-d* connected to the base 114 (the jack 118*d* is not visible in FIG. 5). In some embodiments, one or more mounting brackets (not shown) connect the lower block 94 of the zipper tree 89 to the carriage plate 116 of the adjustable skid 90.

The zipper module 24 is positioned on a transport skid 120 that includes lifting pegs 122*a-d* (the lifting peg 122*d* is not visible in FIG. 5) configured to facilitate placement of zipper module 24*a* on a generally horizontal surface proximate one of the frac trees 34*a-c* via a lifting mechanism, such as, for example, a crane, a forklift, a front-end loader, or another lifting mechanism. The jacks 118*a-d* are connected to respective corners of the base 114 so that, when the adjustable skid 90 is positioned on the generally horizontal surface proximate the frac tree 34*a*, the jacks 118*a-d* are operable to level, and to adjust the height of, the base 114.

The zipper tree 89 includes upper and lower blocks 92 and 94 that have inner fluid passages therethrough and are used for supplying frac fluid to the zipper tree 89 and also—in embodiments like the interconnected frac tree setup 200 in FIG. 2—for directing frac fluid to other zipper trees 89 on a frac site 10. Upper and lower blocks 92 and 94 each may independently swivel around a vertical fluid axis of the zipper tree 89, as indicated by curved arrows 114 and 115, respectively.

A rotatable upper elbow 100 is connected to the upper block 92 and is, in some embodiments, rotatable around the vertical axis of the zipper tree 89, as shown by curved arrow 105. The rotatable upper elbow 100 includes its own internal fluid passage for receiving frac fluid along the internal vertical axis of the zipper tree 89 and directing the frac fluid out of end 102 and toward a connected OSL connection 26 that is connected on the opposite side to a frac tree 34. Alternative embodiments may use different conduits for directing frac fluid out of the zipper tree 89. An elbow, swivel, or similar type of arcuate flow iron may alternatively be used. Also, not all embodiments include a rotatable upper elbow 100. A non-rotatable upper elbow 100, or swivel elbow, or the like, may alternatively be used to direct frac fluid out of the zipper tree 89 and toward the OSL connection 26.

In some embodiments, the upper block 92, lower block 93, and upper elbow 100 are coaxial along an internal fluid channel defined by the upper block 92, lower block 93, and upper elbow 100. Alternatively, any of the upper block 92, lower block 93, and upper elbow 100 may be eschew from any of the others central axes for the fluid channel.

In operation, the zipper module 24 is moved into place and adjusted to the right elevation. The rotation or swiveling of blocks 92 and 24 enable the zipper tree 89 to be aligned with other zipper trees 89 on other zipper modules or aligned with different fluid conduits providing frac fluid. The zipper tree 89 receives frac fluid in either the upper or lower block 92 or 94 and directs the received frac fluid up through an internal channel and out of the frac tree 89 through end 102. End 102 is connected to the OSL connections 26 described herein, which in turn pass the frac fluid to the frac trees 34 for eventual supply to wellheads 20.

Additionally or alternatively, an adjustable-length pipe (not shown) may be incorporated into the zipper tree 89 to provide an additional mechanism for raising or lowering the end 102 being connected to the OSL connection 26. In an example embodiment, the adjustable-length pipe is, includes, or is part of, the pipe 104. In another example embodiment, the adjustable-length pipe is, includes, or is part of the pipe 108. Thus, the adjustable-length pipe (not shown) of the zipper tree 89 is adjustable to facilitate alignment between the zipper module 24 and the frac tree 34.

Figure 6:
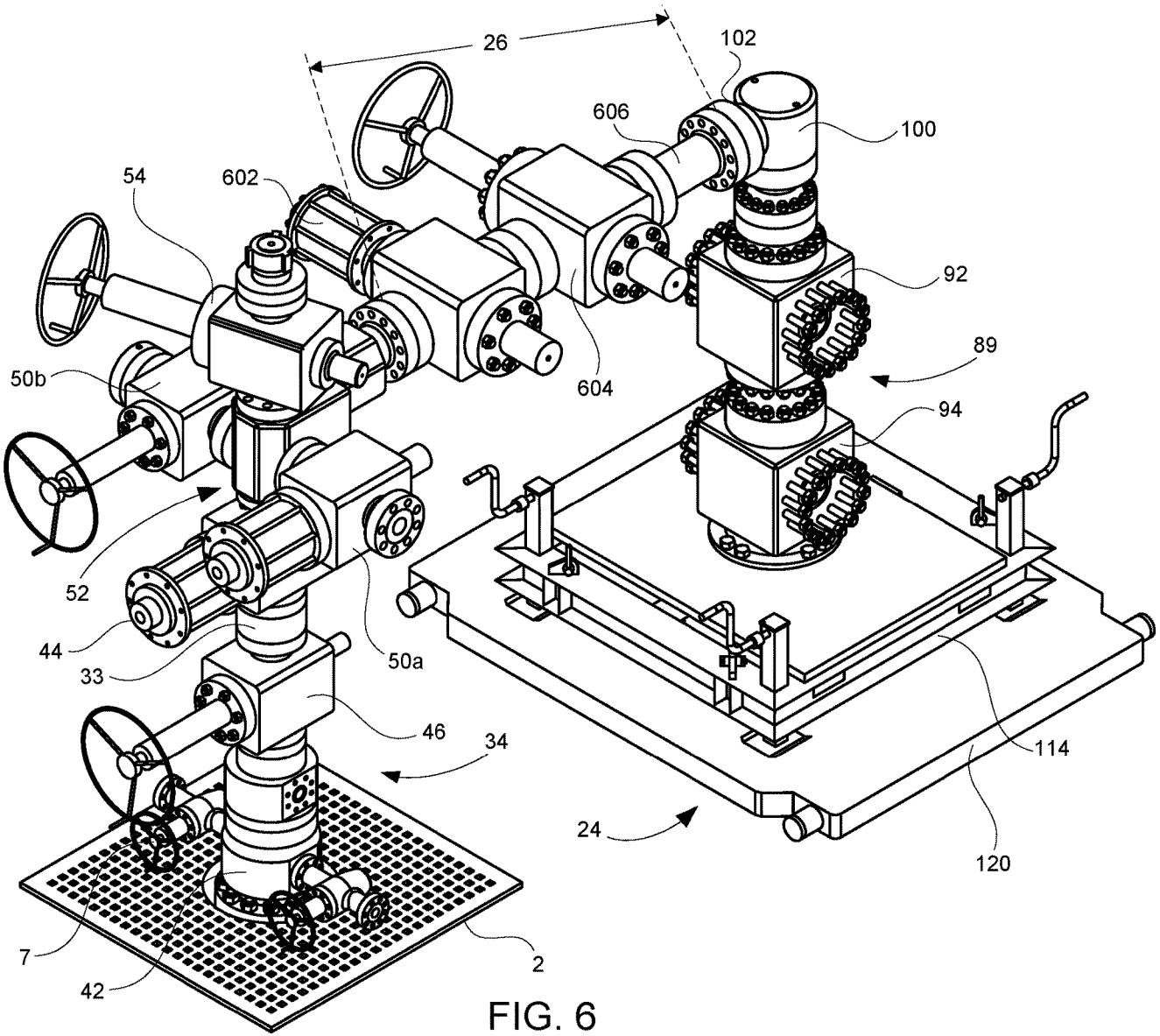
FIG. 6 is a perspective view of a frac tree connected to a zipper module using an OSL connection, according to some embodiments.

FIG. 6 illustrates a perspective view of a frac tree 34 connected to a zipper module 24 via an OSL connection 26, according to some embodiments. Starting at the zipper module, a zipper module 24 comprising a zipper tree 89 sits atop a movable transport skid 120 with an elevatable base 114. The zipper tree 89 includes lower block 94, upper block 92, and elbow 100; all of which may be independently rotatable, and all of which may coaxially share an internal fluid channel defined in the zipper tree 89. And end 102 of the elbow 100 is connected (e.g., bolted, fastened, friction-fit, welded, or the like) to an OSL connection 26.

In some embodiments, the OSL connection 26 includes an OSL conduit 606 connected to the end 102 of the elbow 100, followed by manual gate valve 604 and automatic gate valve 602 connected in series. In some embodiments, the OSL conduit 606, the manual gate valve 604, and the automatic gate valve 602 are coaxial along an internal fluid channel for passing frac fluid received from the zipper tree 89. The depicted embodiment is but one example of a configuration of an OSL connection 26. Additionally or alternatively, plug valves may be used instead of gate valves. Additionally or alternatively, two or more manual or two or more automatic gate valves may be connected in series. The OSL conduit 606, shown as a relatively short piece of pipe may, alternatively, be a flexible hose. In various embodiments, the OSL conduit 606 may be positioned between the gate valves 602 and 604, between the gate valve 602 and the multi-way block 52 of the frac tree 34, or may not be used. Thus, different combinations are fully contemplated by this disclosure than the illustrated OSL connection 26 in FIG. 6.

The OSL connection 26 provides a straight line internal fluid channel, defined by the gate valves 602, 604 and the OSL conduit 606, between the zipper tree and the frac tree. At the frac tree 34, the OSL connection 26, via the depicted automatic gate valve 602, is connected to the multi-way block 52. This depicted multi-way block 52 is a 5-way block that receives frac fluid from the OSL connection 26 and provides an internal passage for the frac fluid to pass down through the frac tree 34 to the wellhead 20. The multi-way block 52 may include the internal passages shown in FIG. 4 and discussed above.

Additionally, as shown in FIG. 6, the multi-way block 52 is also connected to the swab valve 54 on top and the production tee 48 below. Flanking opposite sides of the production tee 48 are a production wing valve 50*a* and kill wing valve 50*b*. Coaxial along an internal vertical frac-fluid passage of the frac tree 344, the production tee 48 is connected in series to gate valve 44, which is connected to conduit 33 and gate valve 46. The gate valve 44 is connected to the production spool 34, and two additional wing gate valves 2 and 4 are connected on opposite sides of the production spool. The frac tree 34 defines an internal fluid passage from the OSL connection 26 to the wellhead 20, along which the production swab valve 54, multi-way block 52, production tee 45, gate valve 44, conduit 33, gate valve 46, and production spool 34 coaxially align.

Figure 7:
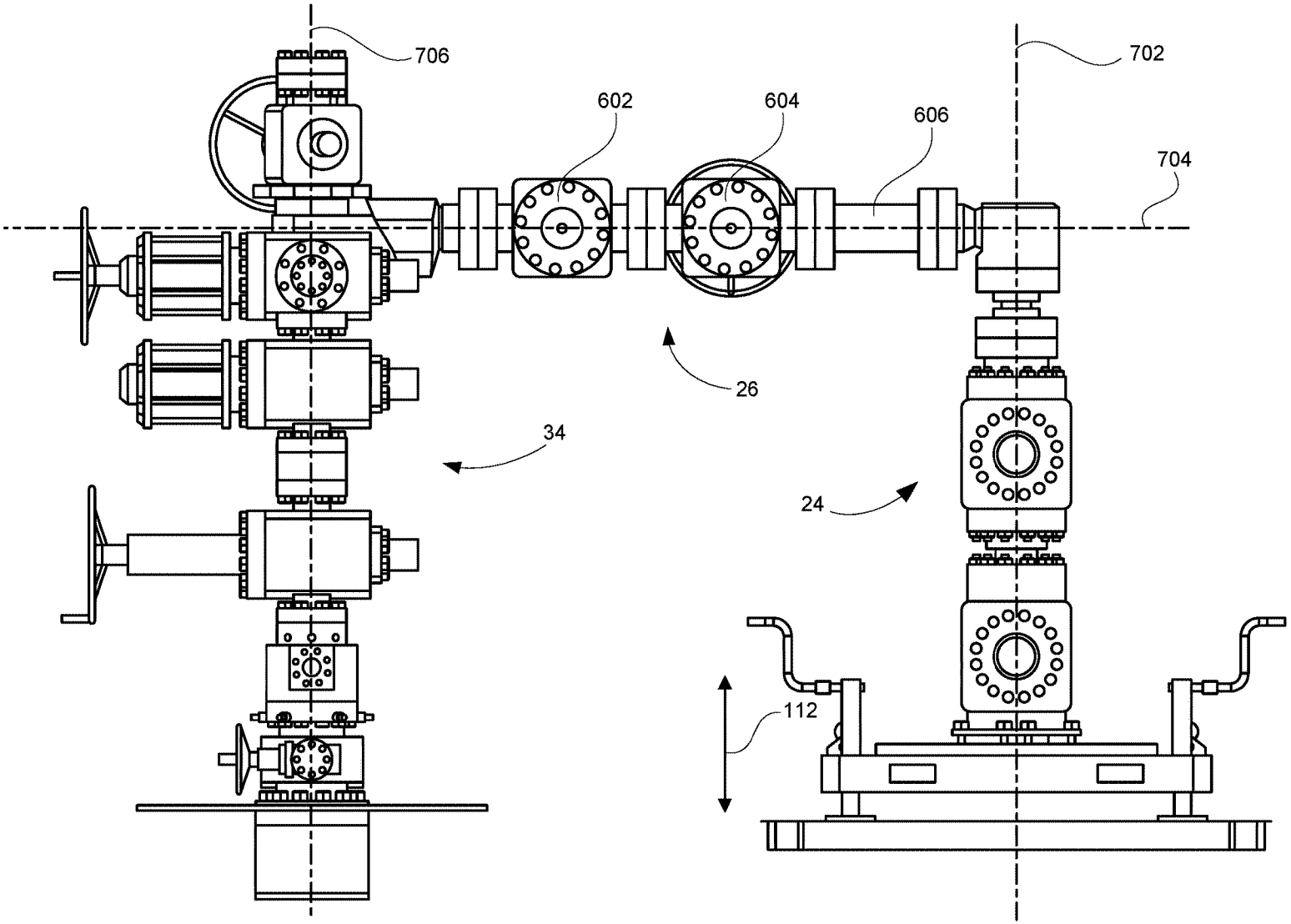
FIG. 7 is a side view of a frac tree connected to a zipper module using an OSL connection, according to some embodiments.
Figure 8:
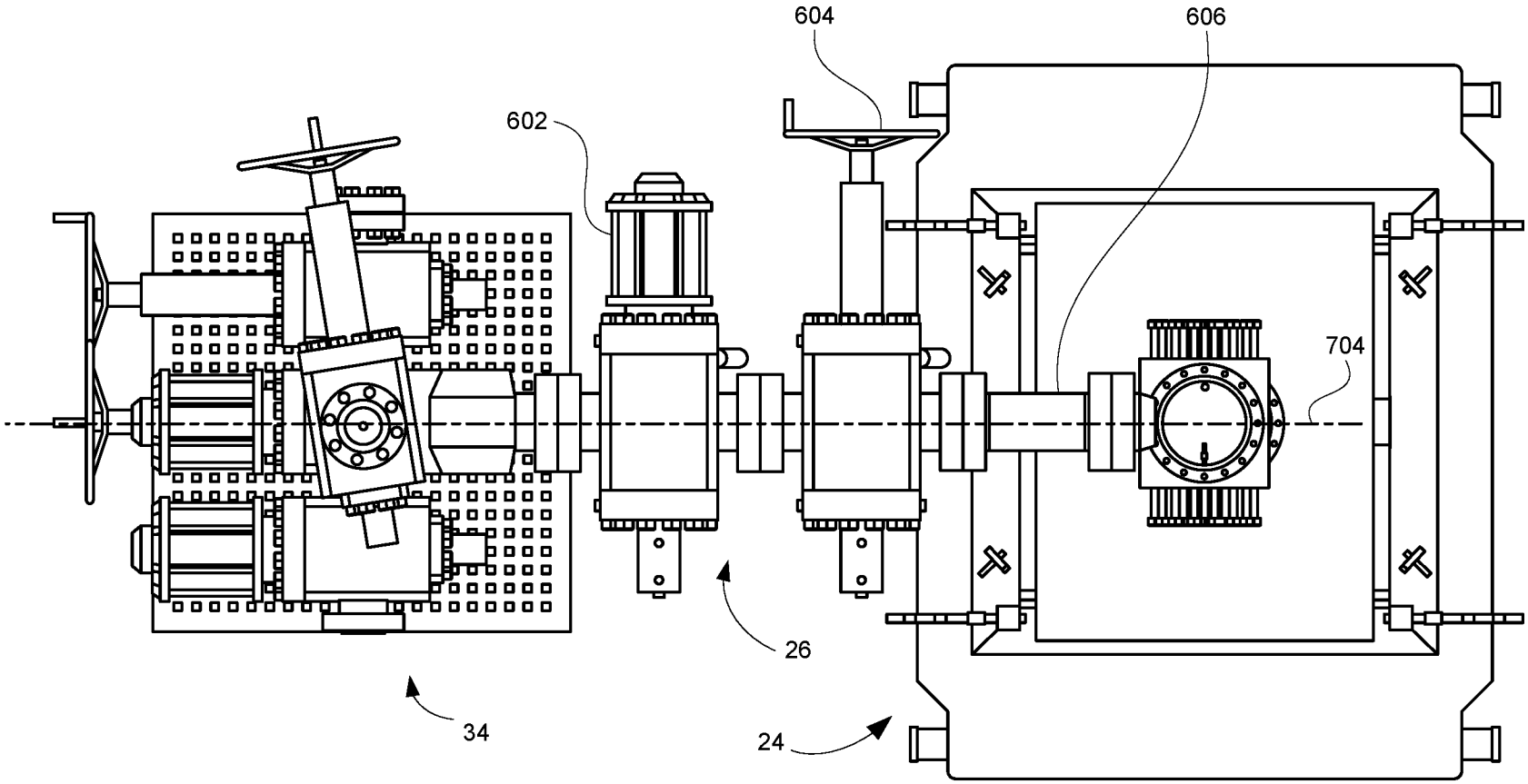
FIG. 8 is a top view of a frac tree connected to a zipper module using an OSL connection, according to some embodiments.

FIG. 7 illustrates a side view of the OSL connection 26 between the frac tree 34 and the zipper module 24, according to some embodiments. Specifically, FIG. 7 illustrates an internal axis 702 of the zipper module 24, along which the previously discussed frac iron of the zipper module 24 align coaxially. Also, relative to the zipper module, the linear arrow 112 illustrates that the base of the zipper module 24 is has been cranked, or otherwise moved, upward. Additionally, internal axes 704 and 706 are shown respectively indicating the internal fluid passages that coaxially align the frac iron in the OSL connection 26 (specifically OSL conduit 606, gate valve 604, and gate valve 602) and the frac tree 34. In some embodiments, the internal axis 704 of the OSL connection 26 is perpendicular to the internal axis of the zipper module 24. Additionally or alternatively, the internal axis 706 of the frac tree 34 may be perpendicular to the internal axis 704 of the OSL connection 26. FIG. 8 shows a top view of this configuration, specifically identifying the internal axis 704 of the OSL connection.

Figure 9:
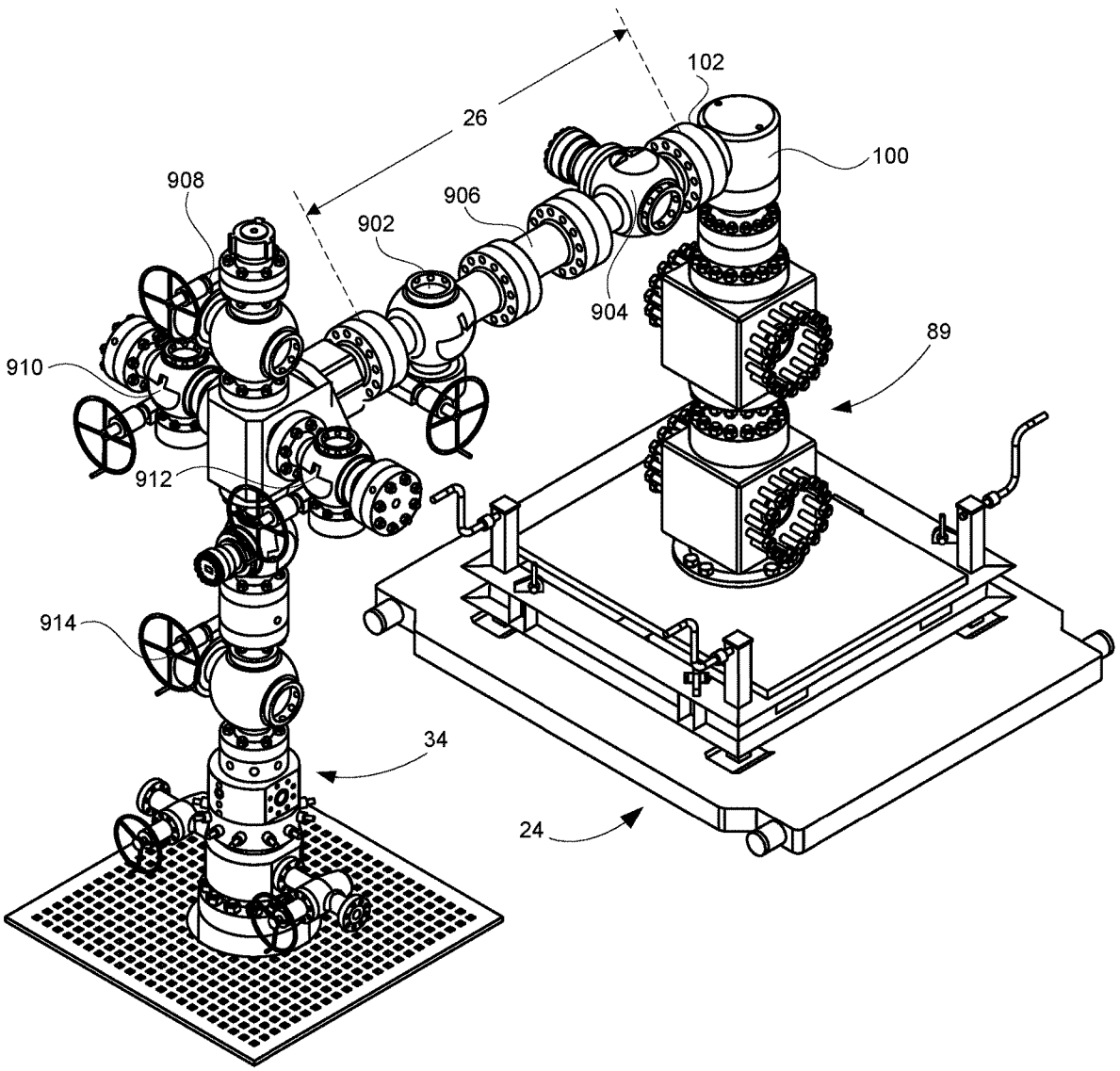
FIG. 9 is a perspective view of a frac tree connected to a zipper module using an OSL connection that includes plug valves, according to some embodiments.

FIG. 9 illustrates an alternative embodiment of a frac tree 34 connected to a zipper module 24 via an OSL connection 26 that uses plug valves 902 and 904, according to some embodiments. In these embodiments, the OSL connection 26 comprises an automatic plug valve 904 connected to the zipper tree 89 at the end 102 of the upper elbow 100. An OSL conduit 906 (e.g., pipe, hose, or the like) is connected in series to the automatic plug valve 904 and a manual plug valve 902. The manual plug valve 902 is connected to the multi-way block 52 of the frac tree 34. The previously discussed gate valves of the frac tree 34 discussed above have been replaced in the frac tree 34 shown in FIG. 9 with plug valves 908, 910, 912, and 914, showing yet another embodiment where plug valves are used instead of gate valves.

Figure 10:
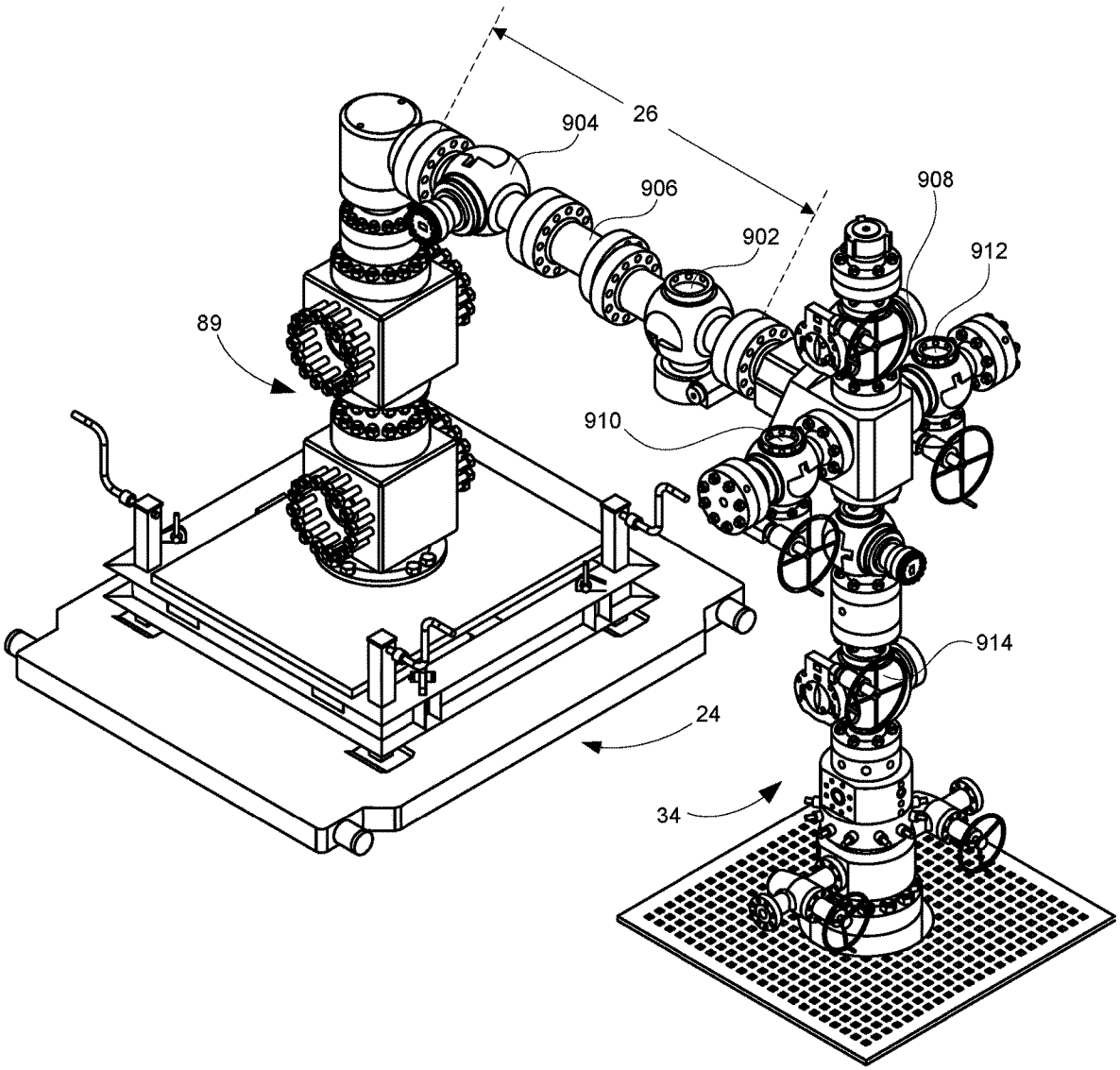
FIG. 10 is another perspective view of a frac tree connected to a zipper module using an OSL connection that includes plug valves, according to some embodiments.

FIG. 10 illustrates a perspective view of the setup in FIG. 9 from a different angle, showing more detail. As can be seen, the plug valves 904 and 902 are automatic plug valves, and the plug valves 910, 912, and 914 are manual plug valves. As mentioned several times above, the embodiments disclosed herein may use any type of manual or automatic plug or gate valves to create the OSL connections 26 discussed herein between the zipper tree 89 of a zipper module 24 and a frac tree 34 connected to a wellhead 20.

Figure 11:
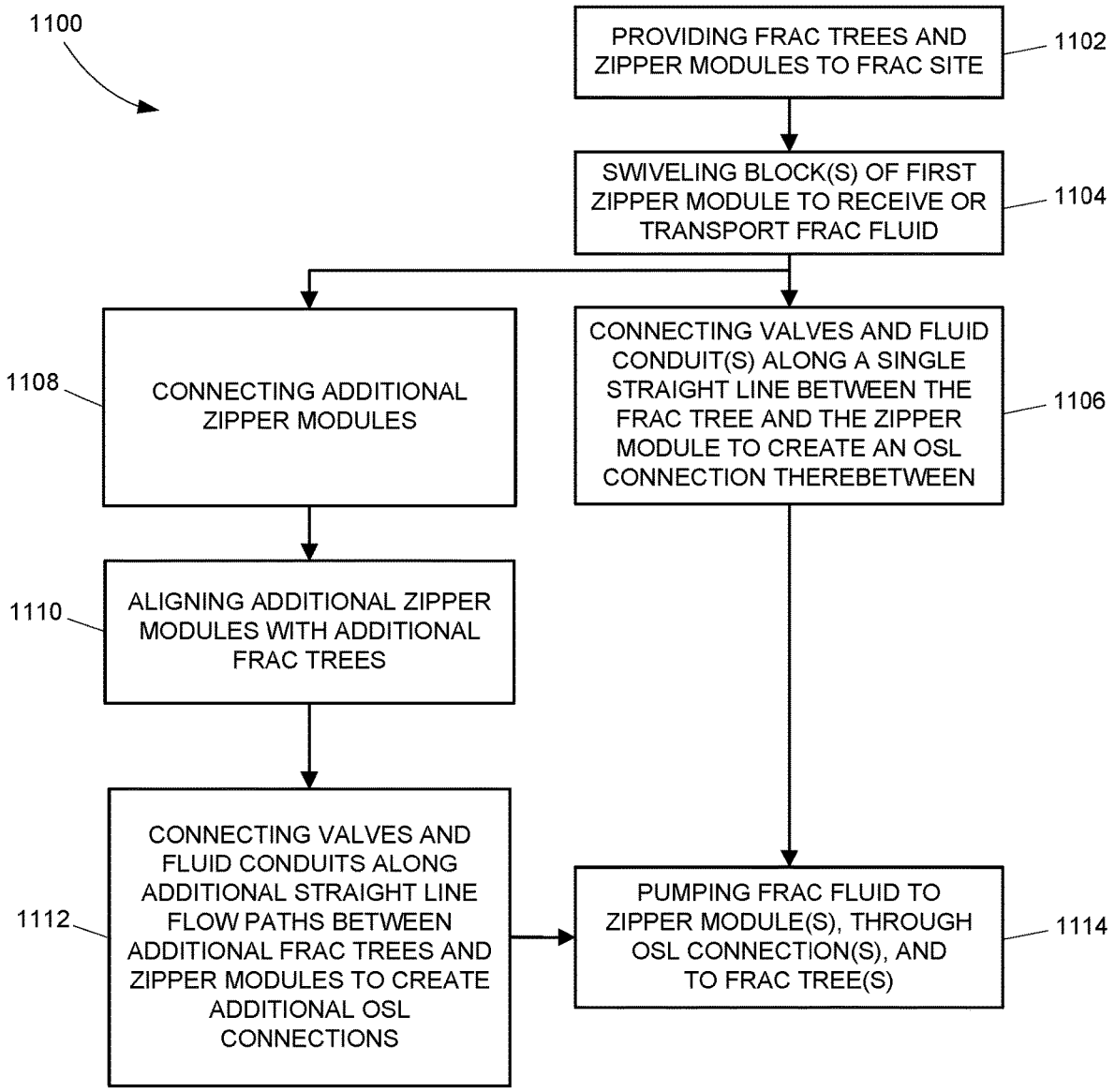
FIG. 11 is a flowchart diagram of a work flow for a frac tree to a zipper module using an OSL connection, according to some embodiments.

FIG. 11 illustrates a flowchart diagram of a work flow 1100 for a frac tree to a zipper module using an OSL connection, according to some embodiments. The work flow 1100 involves providing one or more frac trees and zippers module to a frac site, as shown at step 1102. The frac trees may be positioned in fluid communication with wellheads at the site, and the zipper modules (in some embodiments) are movable by wheels, forklifts, sliders, or other transport onto the frac site. Once on site, upper and lower blocks 92 and 94 mentioned above of a first zipper module are rotated or swiveled to face similar blocks on other zipper modules, as shown at step 1104. Alternatively, these first zipper module blocks may be moved to directly receive frac fluid from one or more frac pumps. As shown at step 1106, an OSL connection is created between a frac tree and the first zipper module by connecting various valves and OSL fluid conduits along a shared OSL fluid axis (e.g., axis 704 referenced above in FIGS. 7 and 8) to a create an OSL connection, thereby providing a single straight-line fluid for frac fluid to be transported from the first zipper module to the frac tree.

Optionally, additional zipper modules may also be connected to the first zipper modules and, possibly, to other zipper modules, as shown at step 1108. These additional zipper modules are connected to respective frac trees at the site, as shown at 1110. Like the first zipper modules, OSL connections are created between the additional zipper modules and their respectively assigned frac trees through connecting valves and OSL fluid conduits along single additional straight-line fluid paths between the additional frac trees and the zipper modules, as shown at step 1112.

Once the zipper modules are connected to each other and their respective frac trees, fracturing fluid is pumped to the zipper modules, through the created OSL connections, and to the frac trees for delivery to wellheads, as shown at step 1114.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes and/or procedures may be merged into one or more steps, processes and/or procedures.

In some embodiments, one or more of the operational steps in each embodiment may be omitted. In some instances, some features of the present disclosure may be employed without a corresponding use of the other features. One or more of the above-described embodiments and/or variations may be combined in whole or in part with any one or more of the other above-described embodiments and/or variations.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right," "front" and "rear," "above" and "below," and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of." A corresponding meaning is to be attributed to the corresponding words "comprise," "comprised," and "comprises" where they appear.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke means-plus-function limitations for any limitations of any of the claims herein, except for those in which the claim expressly uses the word "means" together with an associated function.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A system for establishing a single straight-line fluid path between a fracturing (frac) tree stack and a zipper tree, the system comprising:

a fluid conduit;

a first valve; and a second valve, wherein the fluid conduit, the first valve, and the second valve are coaxially connected to create the single straight-line fluid path along a shared axis between the frac tree and the zipper tree for delivering fluid therebetween, wherein the zipper tree is situated on a base that is adjustable in elevation.

2. The system of claim 1, wherein the first valve and the second valve each comprise a gate valve.

3. The system of claim 1, wherein the first valve and the second valve each comprise a plug valve.

4. The system of claim 1, wherein the first valve comprises a gate valve and the second valve comprises a plug valve.

5. The system of claim 1, wherein the first valve is manually actuatable and the second valve is automatically actuatable.

6. The system of claim 1, wherein the first valve and the second valve are each manually actuatable.

7. The system of claim 1, wherein the first valve and the second valve are each automatically actuatable.

8. The system of claim 1, wherein the first valve or the second valve comprise at least one automatically actuatable valve that may be opened and closed either electrically, electromagnetically, pneumatically, or hydraulically.

9. The system of claim 1, wherein the fluid conduit is connected to an end of the zipper tree, and the first valve is connected to an end of the fluid conduit.

10. The system of claim 1, wherein the fluid conduit is connected between the first valve and the second valve.

11. The system of claim 1, wherein the fluid conduit is connected to a multi-way block that is part of the frac tree.

12. The system of claim 1, wherein the frac tree comprises a multi-way block.

13. The system of claim 12, wherein the multi-way block comprises an internal angled passage that directs fluid received from the single straight-line fluid path to an internal passage of the frac tree directed toward a wellhead.

14. The system of claim 13, wherein the multi-way block comprises at least one member of a group comprising a 3-way, 4-way, or 5-way block with at least one discharge directed to the wellhead.

15. A system comprising a fracturing (frac) tree and a zipper module, the system comprising:

two or more valves coaxially connected in series between the frac tree and the zipper module, the two or more valves defining a single straight fluid path between the zipper module and the frac tree for frac fluid to flow, wherein the zipper module comprises a zipper tree situated on a base that is adjustable in elevation.

16. The system of claim 15, wherein the zipper module defines a first internal fluid passage within the single straight fluid path between the zipper module and the frac tree, the first internal fluid passage being perpendicular to a second internal fluid passage within a second fluid passage within interconnected flow iron of the zipper module.

17. The system of claim 15, wherein the zipper module comprises at least one rotatable block for receiving the frac fluid.

18. The system of claim 17, wherein the frac fluid is supplied to the at least one rotatable block of the zipper module through a conduit having an internal diameter within a range of 3-7 inches.

19. A system for performing hydraulic fracturing of a plurality of wellheads on a frac site, the system comprising:

at least one zipper tree comprising at least one rotatable block for receiving frac fluid for use in performing they hydraulic fracturing, wherein the at least one zipper tree is adjustable in elevation; and an OSL connection comprising at least one gate valve and at least one OSL fluid conduit connected in series and defining a single straight fluid path from the at least one zipper tree to a frac tree.

20. A system comprising a fracturing (frac) tree and a zipper module, the system comprising two or more valves coaxially connected in series between the frac tree and the zipper module, the two or more valves defining a single straight fluid path between the zipper module and the frac tree for frac fluid to flow, wherein the zipper module defines a first internal fluid passage within the single straight fluid path between the zipper module and the frac tree, the first internal fluid passage being perpendicular to a second internal fluid passage within a second fluid passage within interconnected flow iron of the zipper module.

* * * * *